US010060137B2

(12) United States Patent
Van Herpen et al.

(10) Patent No.: US 10,060,137 B2
(45) **Date of Patent: *Aug. 28, 2018**

(54) WALL OR CEILING COVERING WITH LIGHTING SYSTEM LAYER

(71) Applicant: PHILIPS LIGHTING HOLDING B.V., Eindhoven (NL)

(72) Inventors: Maarten Marinus Johannes Wilhelmus Van Herpen, Eindhoven (NL); Markus Cornelius Vermeulen, Nuenen (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/252,924

(22) Filed: Aug. 31, 2016

(65) Prior Publication Data

US 2016/0369515 A1 Dec. 22, 2016

Related U.S. Application Data

(63) Continuation of application No. 13/395,990, filed as application No. PCT/IB2010/054160 on Sep. 15, 2010, now Pat. No. 9,453,340.

(30) Foreign Application Priority Data

Sep. 24, 2009 (EP) ..... 09171201
Feb. 3, 2010 (EP) ..... 10152508

(51) Int. Cl.
*F21S 8/00* (2006.01)
*E04F 13/074* (2006.01)
(Continued)

(52) U.S. Cl.
CPC ..... *E04F 13/074* (2013.01); *E04B 9/32* (2013.01); *E04F 13/002* (2013.01); *F21S 8/02* (2013.01);
(Continued)

(58) Field of Classification Search
CPC ..... E04F 13/074; E04F 13/002; E04B 9/32; F21S 8/02; F21V 23/0485; F21V 31/00;
(Continued)

(56) References Cited

U.S. PATENT DOCUMENTS 4,244,153 A 1/1981 Schwarzer et al.
5,364,672 A 11/1994 Schultze-Kraft
(Continued)

FOREIGN PATENT DOCUMENTS

DE 323081 C 7/1920
DE 934401 C 10/1955
(Continued)

OTHER PUBLICATIONS

CRC Handbook of Chemistry and Physics, 69th Edition, 1988-1999, pp. E-208 and 4-406.

*Primary Examiner* — Anh Mai
*Assistant Examiner* — Hana Featherly
(74) *Attorney, Agent, or Firm* — Akarsh P. Belagodu

(57) ABSTRACT

The invention provides a wall or ceiling covering arrangement (10) comprising a covering material (100) and a lighting system (200) arranged to generate light (210). The covering material (100) has a user side (101) and an opposite back side (102). The lighting system (200) is arranged at the back side (102) of the covering material (100) and the covering material (100) has a light transmission for light (210) generated by the lighting system (200) in the range of 0.5% to 30%, especially in the range of 1% to 20%. The covering material comprises wallpapers.

17 Claims, 7 Drawing Sheets

(51) Int. Cl.

| | |
|---|---|
| ***E04B 9/32*** | (2006.01) |
| ***F21V 23/04*** | (2006.01) |
| ***F21V 33/00*** | (2006.01) |
| ***G09F 13/00*** | (2006.01) |
| ***E04F 13/00*** | (2006.01) |
| ***F21S 8/02*** | (2006.01) |
| ***F21V 31/00*** | (2006.01) |
| *F21W 121/00* | (2006.01) |
| *F21Y 101/00* | (2016.01) |
| *F21Y 115/10* | (2016.01) |

(52) U.S. Cl.
CPC ..... *F21V 23/0485* (2013.01); *F21V 31/00* (2013.01); *F21V 33/006* (2013.01); *G09F 13/00* (2013.01); *F21W 2121/00* (2013.01); *F21Y 2101/00* (2013.01); *F21Y 2115/10* (2016.08); *Y10T 29/49826* (2015.01)

(58) Field of Classification Search
CPC .. F21V 33/006; G09F 13/00; Y10T 29/49826; F21Y 2115/10; F21Y 2101/00; F21W 2121/00
USPC ..... 362/147
See application file for complete search history.

(56) References Cited

U.S. PATENT DOCUMENTS

| | | | |
|---|---|---|---|
| 7,721,672 | B2 | 5/2010 | Nakano et al. |
| 2003/0179420 | A1 | 9/2003 | Fujin |
| 2005/0057945 | A1 | 3/2005 | Pipo et al. |
| 2005/0116667 | A1 | 6/2005 | Mueller et al. |
| 2005/0201087 | A1 | 9/2005 | Ward |
| 2008/0037284 | A1 | 2/2008 | Rudisill |
| 2008/0254253 | A1 | 10/2008 | Gallager |
| 2008/0266843 | A1 | 10/2008 | Villard |
| 2008/0291661 | A1 | 11/2008 | Martin |

FOREIGN PATENT DOCUMENTS

| | | | |
|---|---|---|---|
| EP | 1203657 | A1 | 5/2002 |
| FR | 2858390 | A1 | 2/2005 |
| GB | 159100 | A | 2/1921 |
| GB | 313215 | A | 5/1959 |
| GB | 2407633 | A | 5/2005 |
| JP | 2001310408 | A | 11/2001 |
| JP | 2003281913 | A | 10/2003 |
| JP | 2004191401 | A | 7/2004 |
| JP | 2006235279 | A | 9/2006 |
| JP | 2009099363 | A | 5/2009 |
| JP | 2009123456 | A | 6/2009 |
| WO | WO2004094896 | A2 | 9/2005 |
| WO | 2006115100 | A1 | 11/2006 |
| WO | 2007081254 | A1 | 7/2007 |

WALL OR CEILING COVERING WITH LIGHTING SYSTEM LAYER

CROSS-REFERENCE TO PRIOR APPLICATIONS

This application is a continuation of U.S. patent application Ser. No. 13/395,990, filed on Mar. 14, 2012, which is a U.S. National Phase Application under 35 U.S.C. § 371 of International Application No. PCT/IB2010/054160, filed on Sep. 15, 2010, which claims the benefit of European Application No. 10152508.7, filed on Feb. 3, 2010 and European Patent Application No. 09171201.8, filed on Sep. 24, 2009. These applications are hereby incorporated by reference herein.

FIELD OF THE INVENTION

The invention relates to a wall or ceiling covering arrangement and to a lighting system for use therein. The invention also relates to a use of the wall or ceiling covering arrangement and to a method for providing such a wall or ceiling covering arrangement.

BACKGROUND OF THE INVENTION

Lighting systems on walls or ceilings are known in the art.

For instance, US2005/0201087, addresses that prior art systems can be effectively integrated into the structure of the building but that they do not themselves constitute a wall or a structure. It further states that LED systems embedded in glass are an expensive problem. This document proposes a system comprising support wires and light tiles attached to and supported by the support wires, the light tiles including a light source and a light guide. This document further describes a light tile comprising a light source, a light guide operably connected to the light source, and an attachment unit adapted for attaching the light tile to a support wire.

US2008/0266843 describes a combination, comprising a ceiling tile having a planar surface, and at least one LED fixture integrated with the ceiling tile so that the fixture is arranged along the same plane of the ceiling tile planar surface. Further, this document describes a combination, comprising a building material panel having one or more LEDs integrated therein, wherein the one or more LEDs protrude with respect to a planar facing surface of the building material panel. The building material panel is selected from a group consisting of a ceiling panel, floor panel, wood flooring, laminate flooring, sheetrock, plasterboard, wallboard, brick wall, brick flooring structure, masonry wall, masonry flooring structure and fiber board.

SUMMARY OF THE INVENTION

There is a desire to provide alternative lighting systems, especially for indoor lighting. The use of LEDs increases the last years, since these small light sources allow new designs. Further, it has been found that there is a desire to decrease the visibility of the light source(s).

According to a first aspect of the invention, a new wall or ceiling covering arrangement is provided, which includes both a light function (especially illumination) and a wall or ceiling covering function. This arrangement may be applied to a wall or to a ceiling. Further, in areas or rooms, the systems may be applied to both walls and ceilings.

The wall or ceiling covering arrangement according to the first aspect of the invention (hereinafter also indicated as "covering arrangement") comprises (a) a covering material and (b) a lighting system arranged to generate light, wherein the covering material has a user side and an opposite back side, wherein the lighting system is arranged at the back side of the covering material, and wherein the covering material has a light transmission for light generated by the lighting system in the range of 0.5% to 30%, especially in the range of 1% to 20%.

Such covering material may hide the lighting system for a viewer, but allow light generated by the lighting system to penetrate through the covering material (see also below).

In an embodiment, the invention provides a wall or ceiling covering arrangement comprising (a) a covering material and (b) a lighting system arranged to generate light, wherein the covering material has a user side and an opposite back side, wherein the lighting system is arranged at the back side of the covering material, and wherein the covering material has a light transmission for light generated by the lighting system in the range of 0.5% to 30%, especially in the range of 1% to 20%, wherein the covering material comprises a material selected from the group consisting of plaster, wallpaper, paint, ceramic, paper, wood, plastic, textile, and vinyl.

Especially plaster is of interest, since such material may hide the lighting system well, while also being able to allow light to penetrate in a direction towards a user or observer who is positioned at the user side. The thickness of the plaster layer, the particle size of particles in the plaster, the use of specific type of particles, the selection of the binder(s), may be chosen to tune the transmissive and hiding properties (see also below). Particularly suitable plasters are stone plaster, stucco plaster, synthetic resin plaster, rustic plaster, limestone plaster, and venetian plaster. Also particularly suitable is a granules based plaster, such as a plaster comprising stone granules, preferably marble granules, and a binder, preferably a binder selected from the group consisting of a latex binder and an acrylic resin binder. It appears that such type of plaster may especially be applied to provide the desired transmission of the light of the lighting system as well as the desired hiding of the lighting system. The reason why these plasters may work well is because light may be able to travel through openings between the granules. In addition, the granules themselves may transmit some light. Plaster may thus especially provide light transmission and light output functions.

Alternatively, a wallpaper is also an interesting covering material. Especially vinyl wallpaper and glass fiber wallpaper are of interest, since such material may hide the lighting system well, though also be able to allow light to penetrate in a direction towards a user or observer who is positioned at the user side. Furthermore, vinyl wallpaper may have the advantage that is easy to be cleaned so it does not need to be repainted (which might otherwise lower the light transmission). Fiberglass wallpaper may have the advantage of high heat resistance and non-flammability, which may allow the lighting system to be driven at a higher power.

In a further embodiment, the invention provides a wall or ceiling covering arrangement comprising (a) a covering material and (b) a lighting system arranged to generate light, wherein the covering material has a user side and an opposite back side, wherein the lighting system is arranged at the back side of the covering material, and wherein the covering material has a light transmission for light generated by the lighting system in the range of 0.5% to 30%, especially in the range of 1% to 20%, with the provision that the covering material is not a tufted carpet, or with the provision that the covering material is not a carpet. Hence, in an embodiment, the covering material is not a carpet. The term "carpet" herein refers to (tufted) carpets, but may in an embodiment also refer to (tufted) rugs and in another embodiment also to (tufted) goblins. The term "carpet" may also include (tufted) carpet tiles, such as a carpeted area substantially consisting of an arrangement of (adjacent) (tufted) carpet tiles.

In a further embodiment, the invention provides a wall or ceiling covering arrangement comprising (a) a covering material and (b) a lighting system arranged to generate light, wherein the covering material has a user side and an opposite back side, wherein the lighting system is arranged at the back side of the covering material, and wherein the covering material has a light transmission for light generated by the lighting system in the range of 0.5% to 30%, especially in the range of 1% to 20%. The wall or ceiling covering arrangement further comprises an auxiliary layer, arranged between at least part of the lighting system and at least part of the covering material, wherein the auxiliary layer comprises one or more of an adhesive layer, a levelling layer, a scratch resistance layer, and a liquid-tight layer, such as a waterproof layer.

The auxiliary layer may be arranged between lighting units. It may also be arranged between lighting units or light sources that protrude from a substrate, such as a printed circuit board (PCB). The auxiliary layer may also be arranged on the entire lighting unit or lighting system.

Especially, the auxiliary layer comprises an adhesive layer, that may be applied to the lighting system. Alternatively, adhesion between the lighting system and the covering material may also be achieved by using a covering material that has adhesive properties. For example, when the covering material comprises plaster, the plaster itself may be adhesive (i.e. comprises adhesive material and/or has adhesive properties), and no additional adhesive layer may be necessary.

When the covering material comprises wallpaper, adhesive material may be applied to the wallpaper and/or to the lighting system. The adhesive layer may be a layer with double-sided adhesive properties, wherein one side is for adhering to the lighting system, or to any auxiliary layer that is already present on the lighting system, and the other is for adhering to the wallpaper. This solves possible problems of poor adhesion between the lighting system and the wallpaper. Preferably, the adhesive layer is a thin transparent foil with no apertures. A release liner may be present on the adhesive layer, which can be removed after the lighting system is installed on a wall.

Alternatively, wallpaper paste may be used as adhesive material. Because wallpaper paste usually comprises a liquid, such as water, a liquid transporting layer may be provided between the lighting system and the wallpaper to ensure that the wallpaper paste can dry during assembly of the wall covering arrangement. The wallpaper paste is then applied between the wallpaper and the liquid transporting layer, and the liquid can be transported away from any area of the lighting system that prevents drying of the wallpaper paste, such as a liquid-tight area. Without the liquid transporting layer, such a liquid-tight area could prevent the wallpaper from drying properly.

Because wallpaper paste, particularly when it comprises water and when it is still wet, can be corrosive, it is preferred to combine a water-tight coating (for protection against corrosion) with a liquid-transporting layer.

The liquid transporting layer, particularly when it is a water transporting layer, may have the additional advantage that it can transport water away from any area of the lighting system that can be harmed by the presence of water, such as any electrically conductive area. For example, wet wallpaper paste can oxidise copper to form green copper oxide, if the lighting system comprises circuit boards and copper tape to electrically interlink the circuit boards, the wet wallpaper paste may turn the copper tape green to make it visible through the wallpaper. An example of a suitable liquid transporting layer is a paper layer. Further to the above, the lighting system (including any liquid-tight coating that is provided to the lighting system) is preferably cut open in as many places as possible to allow liquid from the wallpaper paste to pass to the wall with as little interference as possible.

Alternatively or additionally, the auxiliary layer comprises a levelling layer. In this way, a flat wall or ceiling may be obtained, notwithstanding the presence of the lighting system.

Alternatively or additionally, the auxiliary layer comprises a protective layer, such as a scratch resistance layer. As the lighting system may comprise scratch sensitive parts, such parts may be protected with a scratch resistance layer. Especially when plaster is applied to the lighting system, such a scratch resistance layer may be beneficial.

Additionally or alternatively, the auxiliary layer may comprise a liquid-tight layer, such as a waterproof layer, for example a water repellent layer. When applying an adhesive on water basis or when applying plaster, water may penetrate into the lighting system resulting in short circuits and/or rust formation. Hence, in an embodiment, a waterproof layer may be applied to at least part of the lighting system. When using a waterproof layer as auxiliary layer for a lighting system, in combination with an adhesive on water basis to attach the covering material, measures may have to be taken to ensure that the adhesive dries well. Such measurements have already been discussed hereinbefore in relation to the use of a liquid-transporting layer.

When the auxiliary layer is arranged over one or more light sources, the auxiliary layer may be chosen to be transmissive. For instance, a transmissive foil or transmissive adhesive may be used. The auxiliary layer may also be chosen such that it can (plastically) deform to shape itself over the light source(s) (and/or lighting system).

The auxiliary layer may also be arranged in such a way, that the light source(s) (or at least light emitting surface(s) thereof) are free from the auxiliary layer. For instance, the auxiliary layer may comprise one or more holes, arranged to allow light from one or more light source travel through.

Undesired optical artefacts may occur when the holes in the auxiliary layer are relatively large in order to accommodate light sources and additional electrical components. Because light from a light sources can travel within a hole, the larger the hole the larger the light spot of a light source that is located in the hole will be. In order to prevent such undesired optical artefacts from occurring, apertures in the auxiliary can be filled with an opaque material in the areas where no light sources are present. An additional advantage of filling relatively large holes with an opaque material is that it provides levelling so that people can no longer feel the holes when touching the covering arrangement. Furthermore, it provides additional protection to any components that are present in the holes, for example protection from impact when an object hits the wall or ceiling.

Alternatively, the light sources may be located a certain distance away from the additional electrical components. For example, one may use circuit boards wherein the light sources and any additional electrical components are always separated by a distance of 3 mm so that there is no need to make a larger hole in an auxiliary layer to fit both a light source and an additional electronic component.

Additional electrical components may also be provided in compartments that are located in a wall or ceiling, behind the part of the lighting system that comprises the light sources.

With the wall or ceiling covering arrangement according to the first aspect of the invention, a robust wall or ceiling covering may be provided, substantially based on state of the art wall or ceiling covering producing processes, that also provides the option of providing light, while the lighting system itself (being behind the covering material) is not visible. Hence, the wall or ceiling covering may produce light, but the light sources behind the covering material may not be visible. Preferably, the transmission is in the range of 0.5% to 20%, such as 1% to 20%. Especially, the transmission is equal to or smaller than 15%, such as equal to or smaller than 10%, like for instance 1% to 10% or 1% to 5%. Hence, the indicated transmission range may on the one hand provide enough transmission through the covering material, for instance to make the light effect even visible under typical office lighting conditions, especially assuming state of the art LEDs, preferably solid state LEDs, but on the other hand, may substantially prevent visibility of elements (such as for example the light source) under the wall or ceiling covering material (or other elements under the wall or ceiling covering). Visibility of the wall or ceiling or other elements under the wall or ceiling covering may especially not be desired, because the light source (or other elements, like electric wires, reflective foil, a padding) may no longer be hidden. The principle presented here may also be indicated as "hide light": the light sources may be hidden and not visible to a user of the wall or ceiling covering, while the light generated thereby is visible to the user.

An additional advantage of the current invention may be that the covering material is protecting the lighting system that is underneath. Additionally, this may eliminate the need to use a protective housing for the lighting system, which may make the lighting system cheaper to produce. For example, the use of vinyl wallpaper may provide a waterproof enclosure for the lighting system.

The transmission or light permeability can be determined by providing light at a specific wavelength with a first intensity to the material and relating the intensity of the light at that wavelength measured after transmission through the material, to the first intensity of the light provided at that specific wavelength to the material (see also E-208 and E-406 of the CRC Handbook of Chemistry and Physics, $69^{th}$ edition, 1088-1989).

Transmission is measured of light travelling through the covering material from the back side to the user side. The back side is the part of the covering material that is in general arranged on the wall or ceiling (optionally with an adhesive such as glue). The user side is the front side, and is the side that is visible to users when the covering material is arranged as wall or ceiling covering on a wall or ceiling. The intensity of the light downstream of the top face or user side is related to the intensity of the light upstream of the covering material, i.e. at the back side. The light shed on the back side for determining transmission is preferably directed on the back side under normal incidence and the total integrated light emission on the other side of the wall or ceiling covering is measured.

Such wall or ceiling covering arrangement may be used in nearly any type of rooms or areas, such as living rooms, kitchens, bed rooms, play rooms, mud rooms, laundry rooms, aisles, shops, indoor training areas, garages, offices, schools, hotels, libraries, hospitals, transport vehicles (trains, boats, etc.), etc.

The use herein of the phrase "wall or ceiling" may include that in an area or room both or only one of the wall covering arrangement and ceiling covering arrangement are available.

Such wall or ceiling covering arrangement may thus be used to provide wall or ceiling light, i.e. light emanating from the covering material (when one or more the light source(s) of the lighting system are switched on). The lighting of the wall or ceiling covering may be used to light rooms or areas, but may also be used as functional or decorative lighting. The lighting may alternatively or additionally also be used to provide information, like commercial information (trademarks, trade names, prices, etc.), other information (like time, temperature, date), and way finding information, such as directions for finding shops, rooms, entrances, exits, or areas. Especially, the wall or ceiling covering may also be used to provide emergency way finding. Hence, the invention also provides the wall or ceiling covering arrangement as described herein for way guiding, especially for emergency way guiding. Therefore, such wall or ceiling covering arrangement may in an embodiment also be used to provide information with the light, i.e. especially create a lighting pattern on the wall or ceiling (like an arrow, etc.).

In an embodiment, the covering material may comprise a plurality of independent units, such as tiles, panels, or (wallpaper) sheets. The use of units may be advantageous, since in case a light source may need to be replaced, repaired or removed, only the relevant unit(s) may have to be removed (temporarily). In general, the units are arranged adjacent from each other, such that a closed wall or ceiling covering is obtained. Further, the lighting system may comprise a plurality of lighting units, and the wall or ceiling covering arrangement may further comprise a controller arranged to control the lighting system. This may provide freedom in where arranging light sources and may reduce use of material.

The wall or ceiling covering arrangement may further comprise a controller, which may be arranged externally from the wall or ceiling covering arrangement but which may also be integrated in the wall or ceiling covering arrangement, arranged to control the lighting system, and especially the individual light sources of the lighting system. In embodiments wherein the wall or ceiling covering arrangement comprises a plurality of lighting units, the wall or ceiling covering arrangement may comprise one or more controllers. In general, there will be one central controller, herein further indicated as "controller". For larger wall or ceiling areas, optionally a plurality of independent or dependent controllers may be used. Hence, in an embodiment, the wall or ceiling covering arrangement further comprises a controller arranged to control the lighting system; i.e. the controller is arranged to control the light generated by the lighting system. In this way, also for instance information may be provided, like arrows indicating a specific direction, or commercial information. One or more of colour, on/off state, intensity, pattern shape and information content of the light may be variable and may be controlled by the controller. A controller may be integrated in the lighting units. For example, by having a controller on each board (or lighting unit), the different boards may communicate with each other, for instance to determine the on/off states, etc.

Further, the wall or ceiling covering arrangement may comprise a sensor, wherein the controller is arranged to control the light of the lighting system in response to a sensor signal of the sensor. Hence, in an embodiment one or more of colour, on/off state, intensity, pattern shape and information content of the light may be dependent on a sensor signal of a sensor (such as a touch or approach sensor), wherein the sensor is arranged to sense an object on or in the vicinity of the covering material, and wherein the controller is arranged to control or more of colour, on/off state, intensity, pattern shape and information content of the light in dependence of the sensor signal. Therefore, in yet another embodiment, the wall or ceiling covering arrangement further comprises a sensor, such as a touch or an approach sensor, which may be arranged external from the wall or ceiling covering arrangement but which may also be integrated in the wall or ceiling covering arrangement.

According to a further aspect of the invention, a lighting system for use in the wall or ceiling covering arrangement according to the first aspect of the invention is provided.

The lighting system may comprise one or more lighting units, and for instance also electrically connecting cables, etc. The lighting system may especially comprise 2 to 100,000, for instance 2 to 10,000, like 4 to 300, such as 16 to 256 lighting units. In general, the lighting system will comprise a plurality of lighting units, depending upon the area to which the wall or ceiling covering arrangement is applied. The lighting units may be adjacent, or may be arranged at non-zero distances from each other. The lighting units may be powered independently or dependently. The lighting units may for instance be electrically interconnected. A controller (see below), may control one or more lighting units individually. The controller may (also) control one or more light sources individually. For example, a 10 meter corridor in an office might comprise 10 tiles corresponding with 10 lighting units, each lighting unit comprising around 20 to 80 mono-colour LEDs, for instance for outlining an arrow.

A lighting unit in general comprises one or more light sources. The one or more light sources may comprise any light source, such as a small incandescent lamp or a fiber tip or fiber irregularity (arranged to let light escape from the fiber, which embodiment has the advantage that it is relatively cheap), but may especially comprise electrically addressable light sources, such as electroluminescent light sources, for example LEDs (see also below). Hence, the lighting system may comprise a plurality of LEDs. In general, the lighting system may comprise 2 to 10,000 LEDs/$m^2$, especially 25 to 2,500 LEDs/$m^2$. A specific advantage of using LEDs is that they are relatively small and may thereby fit better in a recess in a substrate (see also below). A total thickness of the lighting system below 1 mm is preferred, and this may only be achieved with LEDs. The term LED may refer to inorganic LEDs or to organic LEDs (OLEDs), but especially refers to solid state lighting. Unless indicated otherwise, the term LED herein further refers to solid state LEDs. Especially, the light source is part of a lighting system comprising a plurality of light sources.

Alternatively, the light sources may be photoluminescent light sources, comprising a photoluminescent material that can be excited by ambient light through the covering material. Although LEDs may have a higher light output than photoluminescent materials, an advantage of using a photoluminescent material is that it does not require electricity to operate. Consequently, when using a photoluminescent light source, the lighting system may be more reliable than an electrically powered system. The photoluminescent material preferably is a phosphorescent material that continues to emit light, for example for a couple of hours, even in the absence of ambient light as excitation source. When using a photoluminescent light source, a desired light output of the lighting system may be obtained by tuning the light-emitting area of the photoluminescent light source. Because the photoluminescent light source is hidden behind the cover layer, scaling of the light-emitting area is no problem for the aesthetics of the lighting system.

Note that the lighting system may at least be partly surrounded by the covering material. For instance, the lighting system may partially penetrate into the covering layer. For example, plaster might be partially going around the lighting system.

Solid state LEDs as light source(s) are especially desired because of their small dimensions. Such light sources with state of the art technique may be less than 1 mm thick, even in the range of about 0.2 mm (excluding a support structure of 0.5 mm to 1 mm thickness, such as a printed circuit board), or smaller. When arranging such light source (for example having a total thickness of 1 mm including support structure) on a wall or ceiling, the covering material may be arranged over the light source without substantial influence of the (presence of the) light source on the (local) surface height of the covering material.

Preferably, the total height of the light sources, and even more preferably the total height of the lighting system is at maximum 1 mm, preferably less, such equal to or less than about 0.7 mm, especially 0.5 mm or less, such as 0.2 mm to 0.4 mm, like 0.3 mm.

The lighting system is preferably made as thin as possible and is preferably very flat, because otherwise the outlines of the lighting system may be visible through the cover layer. Flatness may for instance be achieved by the herein described levelling layer. Thick(er) systems may however also be applied, but especially then, levelling may be necessary. For instance, cement or other filler may be applied to the wall or ceiling to fill gaps between lighting units and thereby, a levelling layer is provided.

Nevertheless, it may be preferred to take into account the presence of a light source under the covering material and include a means that may level the lighting system.

In an embodiment, the lighting system comprises a wedge-shaped edge, which is an edge that gradually thins or narrows towards the surface of a wall or ceiling on which the lighting system is to be mounted. The wedge-shaped edge can be characterized as having a first face for being adjacent to the wall or ceiling, and a second face for being adjacent to the covering material, the first face and the second face enclosing an angle $\phi$ that is smaller than 6 degrees, more preferably smaller than 1.5 degrees, such as for example 1.1 degrees. In other words, the distance over which the wedge-shaped edge gradually narrows towards the surface is at least 10 times as large as the thickness of the lighting system. By having such a wedge-shaped edge, the lighting system has reduced visibility through the covering material.

In an embodiment, the lighting system has a top side for facing the covering material and a back side for facing the wall or ceiling, the top side having adhesion promoting properties, preferably wherein at least part of the top side is rough, to promote adhesion of the covering material to the lighting system.

Additionally or alternatively, at the top side the lighting system may comprise one or more auxiliary layers chosen from the group consisting of adhesive layers, levelling layers, and protective layers. Such adhesive layers have already been described above, in relation to the wall or ceiling arrangement according to the first aspect of the invention. The auxiliary layer may comprise plastic, felt, PCB material (i.e. insulating material such as poly tetra fluoroethylene or FR-4, etc.), or other materials.

Particularly when the lighting system comprises one or more light sources provided on a printer circuit board, the one or more auxiliary layers preferably comprise a liquid-tight protective layer, wherein the lighting system further comprises a liquid-transporting layer at the side of the liquid-tight protective layer facing away from the printed circuit board.

When the lighting system is to be used in a wall or ceiling covering arrangement wherein the covering material is to be attached with a water-based adhesive layer, and when the lighting system has a liquid-tight protective layer as auxiliary layer, measures may have to be taken to ensure that the water-based adhesive layer dries well. Such measurements have already been discussed hereinbefore in relation to the use of a liquid-transporting layer in the wall or ceiling covering arrangement according to the first aspect of the invention, and the same advantages apply here.

In a further embodiment, the lighting system comprises one or more light sources and a substrate with one or more cavities or recesses for hosting the one or more light sources. The one or more light sources may be partly or completely recessed in the one or more cavities or recesses, respectively. When the one or more light sources and/or other electrical components (such as electrical connections, resistors, transistors, power sources, controllers) are hosted in one or more cavities or recesses, a substantially flat lighting system may be obtained.

A specific example of a substrate is a printed circuit board (PCB). The light sources and/or other (electronic) components of the lighting system may be embedded in a levelling layer on the PCB. This levelling layer may especially (also) be PCB material. The levelling layer may comprise openings or recesses, wherein one or more parts of the lighting system may be arranged, especially the light sources. Such a substrate with a levelling layer can be considered to be a laminate, such as a PCB laminate. The advantage of using PCB material as levelling layer is that the recessed structure may be manufactured in the manufacturing process of PCB laminates.

Conducting layers in PCBs are typically made of thin copper foil. Insulating layers (dielectrics) are typically laminated together with epoxy resin pre-preg. Dielectrics may for instance be chosen from the group consisting of poly tetra fluoroethylene, FR-4, FR-1, CEM-1 or CEM-3. Well known pre-preg materials used in the PCB industry are FR-2 (phenolic cotton paper), FR-3 (cotton paper and epoxy), FR-4 (woven glass and epoxy), FR-5 (woven glass and epoxy), FR-6 (matte glass and polyester), G-10 (woven glass and epoxy), CEM-1 (cotton paper and epoxy), CEM-2 (cotton paper and epoxy), CEM-3 (woven glass and epoxy), CEM-4 (woven glass and epoxy), CEM-5 (woven glass and polyester).

In an embodiment, the lighting system comprises openings through the entire lighting system such that the wall or ceiling covered by the wall or ceiling covering arrangement that comprises the lighting system is exposed through these openings. The advantage of this approach is that no auxiliary adhesive layer may be necessary, because the covering material may adhere directly to wall or ceiling. To prevent the outlines of these openings to be visible through the covering material, it is preferred to have a very thin lighting system, or to use the lighting system in combination with a covering material layer that is less sensitive to height differences, such as for example covering material comprising a plaster.

According to a further aspect of the invention, the wall or ceiling covering arrangement or the lighting system for use in such a wall or ceiling covering arrangement is provided in combination with a sensor and a controller, wherein the sensor is arranged to provide a sensor signal when the sensor is approached or touched, and wherein the controller is arranged to control one or more parameters selected from the group consisting of a lighting parameter (such as one or more of colour, colour distribution, light intensity, light intensity distribution, blinking frequency, etc.) of the wall or ceiling covering arrangement or the lighting system, respectively, pattern shape of the light, and information content provided by the light. Patterns or information will in general be provided by a plurality of light sources.

According to a further aspect of the invention, a covering material per se is provided, having a user side and an opposite back side, and having a light transmission for light in the range of 0.5% to 30%, especially in the range of 1% to 20% (see also above). Especially, the covering material comprises a material selected from the group consisting of wallpapers, especially one or more of vinyl wallpaper and glass fiber wallpaper.

According to a further aspect of the invention, a covering unit is provided, such as a panel, a sheet or a tile, especially a panel or a sheet, such as a wallpaper sheet, having a user side and an opposite back side, and having a light transmission for light in the range of 0.5% to 30%, especially in the range of 1% to 20% (see also above). In an embodiment, the covering unit may further comprise a lighting unit arranged at the back side of covering unit, wherein the covering unit and the lighting unit are integrated. Such unit may be used as one unit that advantageously combines lighting properties and covering properties in one unit. Such unit may be replaced in one action.

According to a further aspect of the invention, a use of the wall or ceiling covering arrangement according to the first aspect of the invention is provided, the use being way finding.

According to a further aspect of the invention, a way-guiding system comprising the wall or ceiling covering arrangement according to the first aspect of the invention is provided. The way-guiding system may be an emergency exit finding system.

According to a further aspect of the invention, a method for providing the wall or ceiling covering arrangement according to the first aspect of the invention is provided, the method comprising arranging a lighting system on a wall or ceiling, optionally arranging a auxiliary layer on at least part of the lighting system, and arranging the covering material, optionally in the form of a plurality of tiles, over the lighting system.

Especially, the method comprises the steps of arranging a lighting system to the wall or ceiling, and applying a covering material over the lighting system. Optionally, the lighting system, or elements thereof, such as cables, etc., may be arranged in a recess/recesses in the wall or ceiling. Hence, in a specific embodiment, the method also comprises providing one or more recesses to the wall or ceiling and arranging the lighting system in the one or more recesses.

When the wall is (too) uneven after application of the lighting system, one may level the wall. Hence, in a specific embodiment, the method may also comprise arranging the lighting system to the wall or ceiling and levelling the wall or ceiling. Levelling may be done by applying one or more layers to at least part of the wall and/or at least part of the lighting system. For instance, free parts between lighting systems may be levelled to substantially the same height as the lighting systems. Hence, in embodiments wherein the wall or ceiling comprises free surface, the method may further comprise applying levelling material to at least part of the free surface. This may be done to provide a substantially flat surface. Levelling material may for instance be an (inert) layer, but may also be adhesive. Levelling material may for instance be cement or another similar wall levelling material. By providing levelling material, unevenness may substantially be removed.

Assuming a wall or a ceiling to which a covering arrangement is applied, preferably the covering arrangement is applied to at least 50%, such as at least 80%, especially at least 95% of the total area of the wall or ceiling, respectively. In yet another embodiment, the covering arrangement (on a wall or ceiling) has a user side area in the range of at least 2 $m^2$, such as at least 4 $m^2$, especially at least 10 $m^2$, such as in the range of 2 $m^2$ to 1000 $m^2$, like 10 $m^2$ to 1000 $m^2$. Such user side area is in an embodiment preferably a closed area, in the sense that there is one integral area, without substantial openings between parts of the covering material. When covering units are applied, the distance (seams) between adjacent units is preferably less than about 20 mm, especially less than about 10 mm, even more especially less than about 5 mm, such as preferably less than about 1 mm, especially less than about 0.5 mm.

Terms like "below", "above", "top", and "bottom" relate to positions or arrangements of items which would be obtained when the wall or ceiling covering arrangement/covering material (or tiles) are arranged in a normal end user position (such as tiles on a wall or plaster on a wall or ceiling). However, this does not exclude the use of the wall or ceiling covering arrangement in other arrangements, such as against a wall, or in other (vertical) arrangements.

The terms "upstream" and "downstream" relate to an arrangement of items or features relative to the propagation of the light from a light generating means (here the lighting system, especially the light source, such as the LED), wherein relative to a first position within a beam of light from the light generating means, a second position in the beam of light closer to the light generating means is "upstream", and a third position within the beam of light further away from the light generating means is "downstream".

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1:
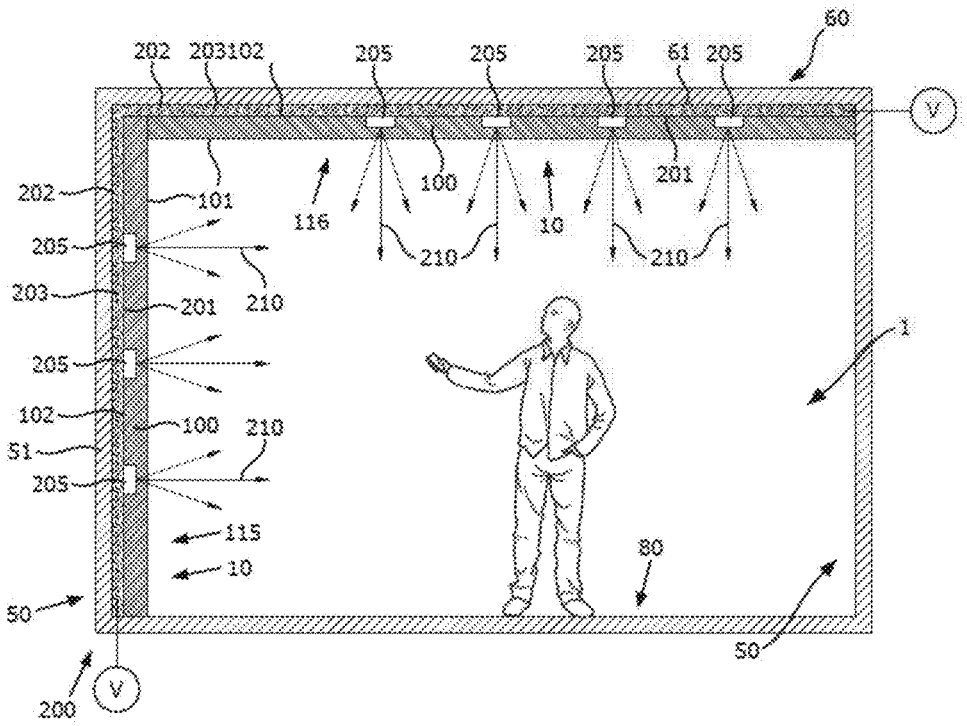
FIG. 1 schematically depicts embodiments of the wall and ceiling covering arrangements according to the invention.

FIG. 1 schematically depicts an embodiment of a wall or ceiling covering arrangement 10. The wall or ceiling covering arrangement 10 comprises a covering material 100, and a lighting system 200 arranged to generate light 210.

Herein, the species wall covering arrangement is also indicated by reference numeral 115, while the species ceiling covering arrangement is indicated with reference numeral 116.

By way of example, the room 1 has a wall 50, a ceiling 60, and a floor 80. The wall 50 is provided with the wall covering arrangement 115, that is applied to substantially the entire surface 51 of the wall 50 on the left side of FIG. 1. Further, by way of example, the ceiling 60 is provided with the ceiling covering arrangement 116 that is applied to substantially the entire surface 61 of the ceiling 60.

The covering material 100, that may for instance be wallpaper or plaster, has a user side 101 and an opposite back side 102. The lighting system 200 has a top side 201 and a bottom side 202. The lighting system 200 is arranged at the back side 102 of the covering material 100. As can be seen in FIG. 1, the top side 201 of the lighting system 200 and the back side 102 of the wall or ceiling covering 100 are facing each other. The back side 102 may also be indicated as illumination side. The lighting system 200 in this embodiment comprises a plurality of light sources 205, such as LEDs. The lighting system 200 is arranged to generate light 210 (when switched on). In this embodiment, the lighting system 200 comprises one lighting unit 250 (i.e. the lighting unit is the lighting system); in general the lighting system 200 may comprise a plurality of lighting units 250 (see below). The lighting system 200 may be powered by an external power source (indicated with "V").

The covering material 100 has a light transmission for light 210 generated by the lighting system 200 in the range of 0.5% to 30%, especially in the range of 1% to 20%. In this way, an observer/user perceiving the user side 101 of the covering material 100 will essentially not see the lighting system 200 or other items behind the back side 102 of the covering material 100. The observer will observe the covering material 100 as "normal" covering material 100. However, when the lighting system 200 provides light 210, this light 210 is observed by the observer. The source of light is hidden; the light itself is perceived.

The invention is also directed to the covering material 100 per se, which covering material 100 (thus) has user side 101 and opposite back side 102, and has a light transmission for light 210 in the range of 0.5% to 30%, especially in the range of 1% to 20%.

The covering material 100 may for instance be selected from the group consisting of plaster, paint, a ceramic tile, paper, wood, plastic, textile, and vinyl, especially one or more of stone plaster, stucco plaster, synthetic resin plaster, rustic plaster, limestone plaster, and venetian plaster, and wallpapers, especially one or more of vinyl wallpaper and glass fiber wallpaper.

The lighting system 200 in general comprises a substrate or support, indicated with reference 203, which substrate or support 203 comprises the light source(s) 210. For instance, support 203 may be a printed circuit board (PCB). To such a PCB, LEDs may be provided.

Figure 2A:
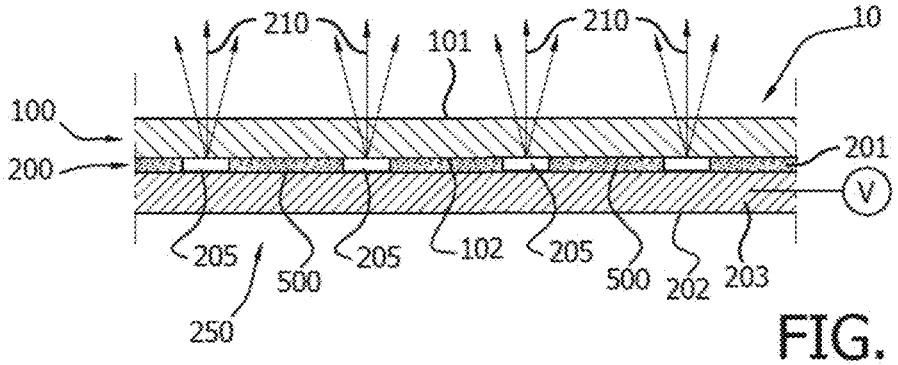
FIGS. 2*a* to 2*g* schematically depict embodiments and variants thereof of the wall or ceiling covering arrangement according to the invention.
Figure 2B:
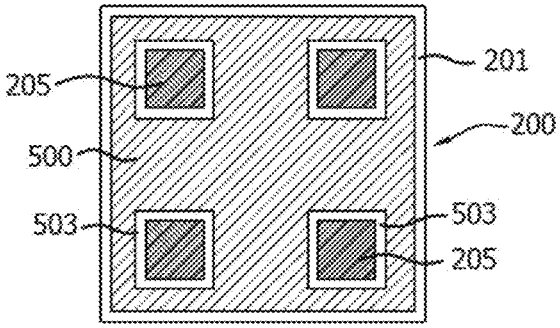
Figure 2C:
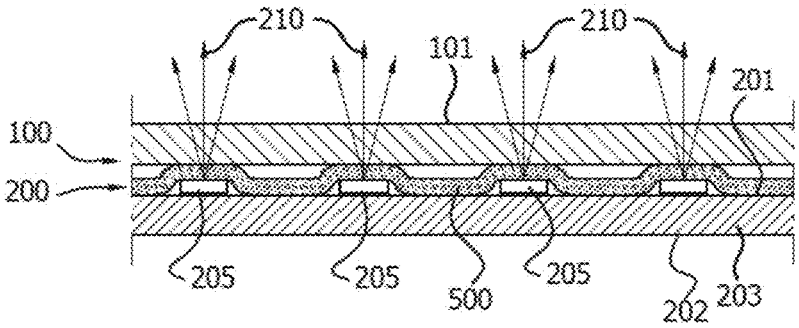

FIGS. 2*a* to 2*c* schematically depict non-limiting means/embodiments with an auxiliary layer, for instance to smooth or level the lighting system 200. These embodiments show an auxiliary layer 500, arranged between at least part of the lighting system 200 and covering material 100. In FIG. 2*a*, the auxiliary layer 500 is substantially only present between the light sources 205 and not over the light sources 205. FIG. 2*a* schematically depicts a cross-section. To illustrate the terms "downstream" and "upstream" in relation to FIG. 2*a*: user side 101 is downstream of back side 102; back side 102 is upstream of user side 101. FIG. 2*b* schematically depicts a top view of the embodiment of FIG. 2*a*, however without covering material 100. It can be clearly seen that the auxiliary layer 500 has openings, indicated with reference 503, for the light sources 205. Hence, the lighting system 200 may provide light 210, without substantial absorption of the auxiliary layer 500, since the auxiliary layer 500 has openings 503 to allow light 210 travel in the direction of the covering material 100. The auxiliary layer 500 may for example be made of a PCB layer with apertures (see also below). Therefore, the levelling layer may in an embodiment be made of PCB material.

FIG. 2*c* schematically depicts an embodiment wherein the auxiliary layer 500 is also arranged over the light sources 205. The auxiliary layer may be chosen to be transmissive for light 210 of the lighting system 200.

The auxiliary layer 500 may be part of the lighting system 200, i.e. it may be a layer attached to the lighting system 200. For instance, it may be a laminate of support 203 (such as a PCB) and auxiliary layer 500.

The auxiliary layer may for instance have one or more characteristics selected from the group consisting of adhesion, levelling, waterproof, water repellent, scratch resistance, etc.

Figure 2D:
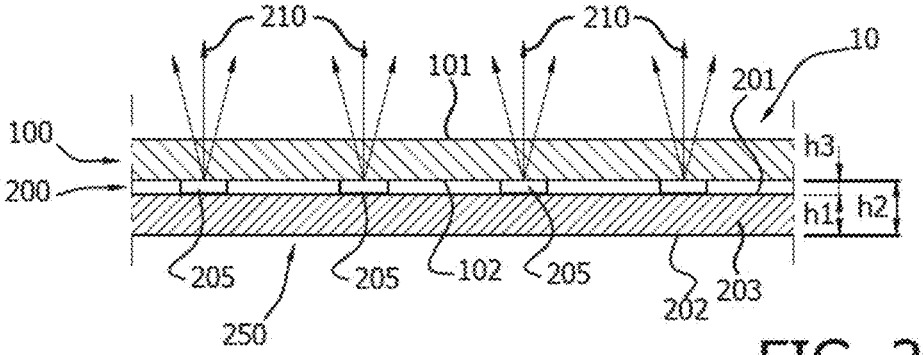

FIG. 2*d* is used to illustrate some parameters of the lighting system 200. The total height of the lighting system is indicated with h2; the height of the support 203 is indicated with h1 and the height of the light source(s) 210, if protruding from the top side 201 of the lighting system 200 (or support 203), is indicated with h3; i.e. h2=h3+h1. The total height h2 may for instance be in the range of about 1 mm.

Figure 2E:
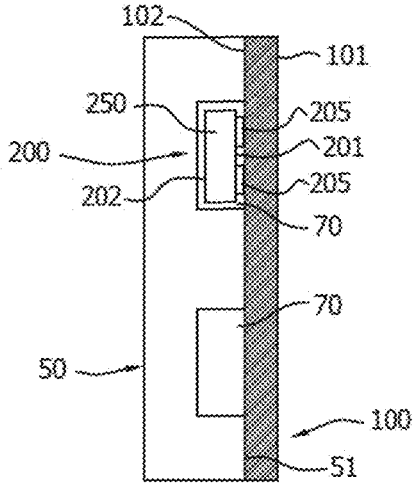

FIG. 2*e* schematically depicts an embodiment wherein the wall or ceiling, here by way of example wall 50 comprises one or more recesses, indicated with reference 70, wherein at least part of the lighting system 200, such as one or more units and/or electric cables, may be arranged. In this way, part or the entire lighting system 200 may be partly or completely recessed. Thereby, a substantially flat wall surface 51 (or ceiling surface 61, respectively) may be provided. In the example depicted, a lighting unit 250 with two light sources 205 are completely recessed in one of the recesses 70.

Figure 2F:
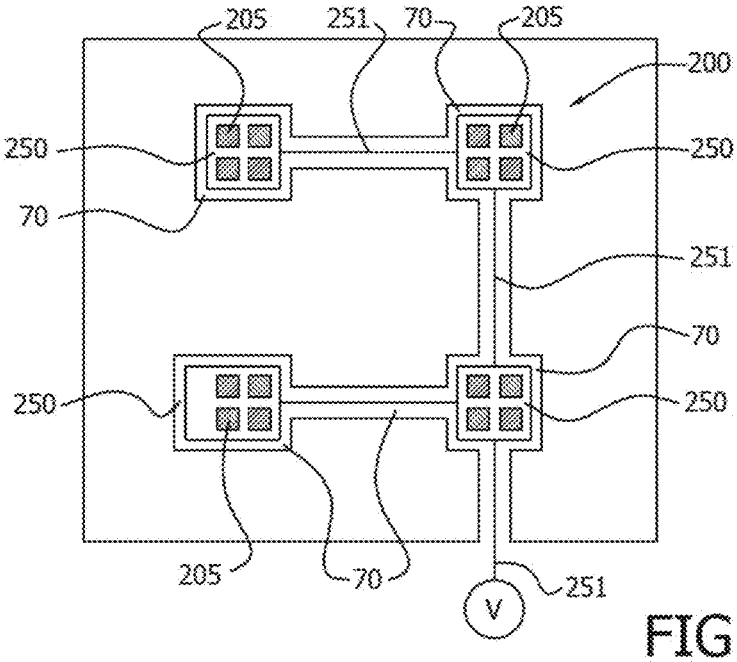

Whereas FIG. 2*e* may schematically depict a cross-section of a wall (or ceiling), FIG. 2*f* schematically depicts a front view. By way of example, also electric cables or connections 251 are shown, which are in this example also recessed in recesses 70. Hence, FIG. 2*e* schematically depicts an embodiment wherein substantially the entire lighting system 200 (here comprising by way of example 4 lighting units 250 (and cables 251, etc.) is at least partly recessed in recesses 70. In this way, covering material may be provided to a substantially flat surface of the wall or ceiling.

Figure 2G:
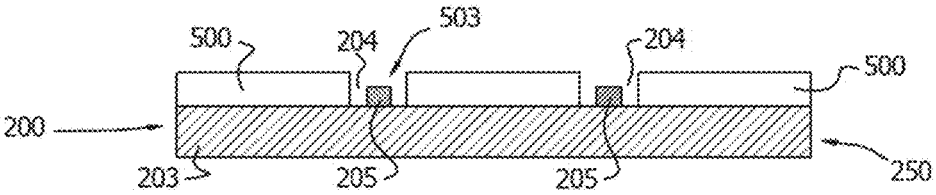

FIG. 2*g* depicts a specific variant of the lighting system 200 schematically depicted in FIG. 2*a*. The lighting system 200 comprises a substrate 203, which is especially a PCB. Light sources 203 and/or other (electronic) components of the lighting system 200 are embedded in levelling layer (indicated as auxiliary layer 500), in recesses 204 (these recesses 204 may also be indicated as openings 503). In this way, a flat lighting system 200 may be provided. The levelling layer may also be PCB material, laminated to the PCB substrate. Hence, in this way a PCB with one or more recesses 204 may be obtained, especially for hosting one or more light sources 205. The one or more recesses 204 may be arranged to host one or more light sources 205 and/or one or more other electrical components, such as electrical connections, power source(s), controller(s), etc. The lighting unit 250 schematically depicted in FIG. 2*f* may be considered a laminate.

Figure 3A:
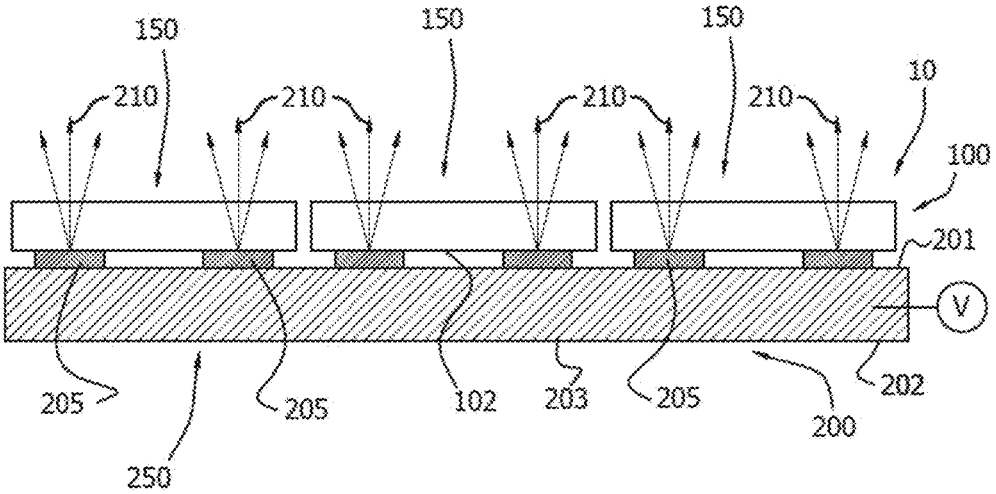
FIGS. 3*a* to 3*b* schematically depict embodiments and variants thereof of the wall or ceiling covering arrangement according to the invention.
Figure 3B:
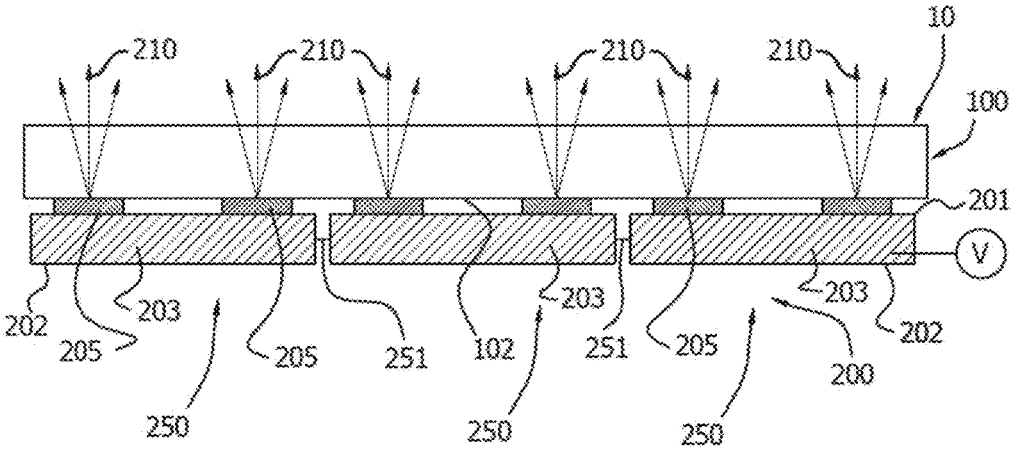

FIG. 3*a* schematically depicts an embodiment wherein the covering material 100 comprises a plurality of independent units 150, such as wallpaper sheets. FIG. 3*b* schematically depicts an embodiment wherein the lighting system 200 comprises a plurality of lighting units 250. FIG. 3*b* by way of example also shows (optional) electric connections 251 between (adjacent) lighting units 250. Note that the wall or ceiling covering arrangement 100 may also comprise a plurality of independent units 150 and plurality of lighting units 250. In an embodiment, the number of independent units 150 may be larger than the number of lighting units 250. In such embodiment, when lighting units 250 may not be adjacent, (also) a auxiliary layer may be arranged between the lighting units 250. A unit may for instance have dimensions like 1 cm to 50 cm length and width, and 0.1 mm to 1 mm height.

Figure 4A:
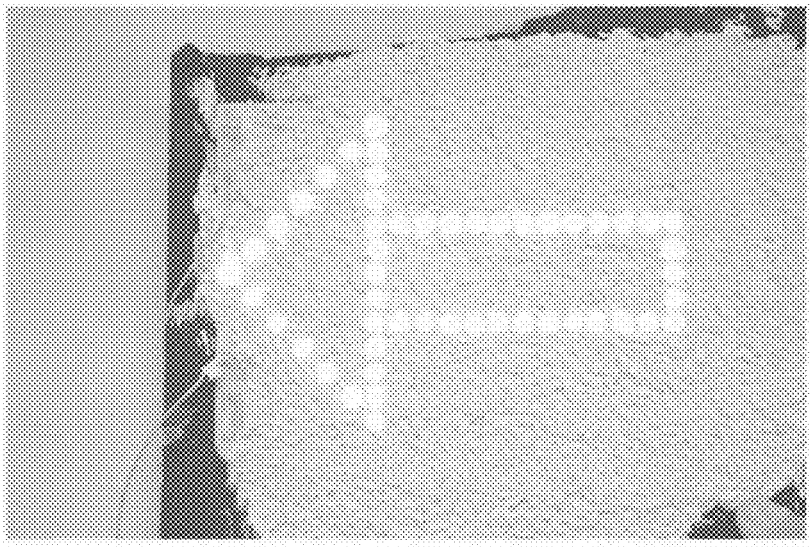
FIGS. 4*a* to 4*b* schematically depict an example of a wall (or ceiling) covering arrangement with plaster and LEDs.
Figure 4B:
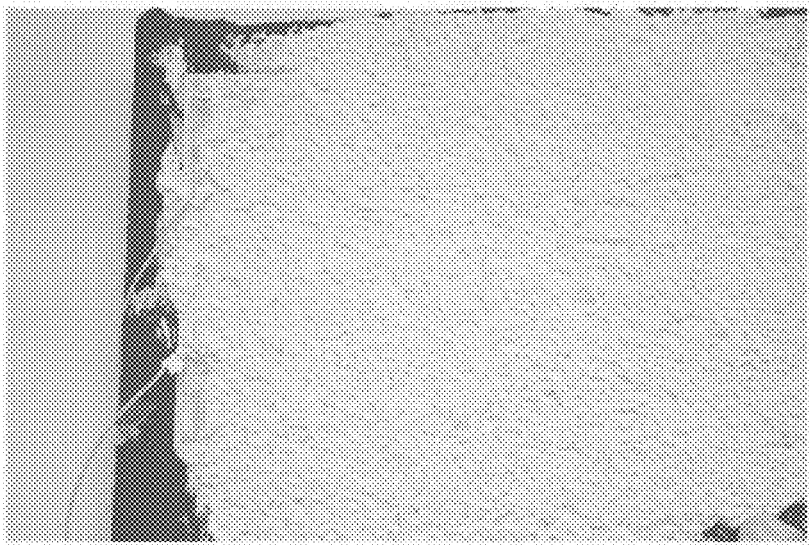

FIGS. 4*a*-4*b* shows an example of a plaster wall with LEDs behind the plaster. FIG. 4*a* shows light escaping from the wall, here by way of example also carrying information (way finding for instance). FIG. 4*b* shows the lighting system (or unit) in the off state: the wall is perceived as normal wall and the lighting system is not visible.

Figure 5:
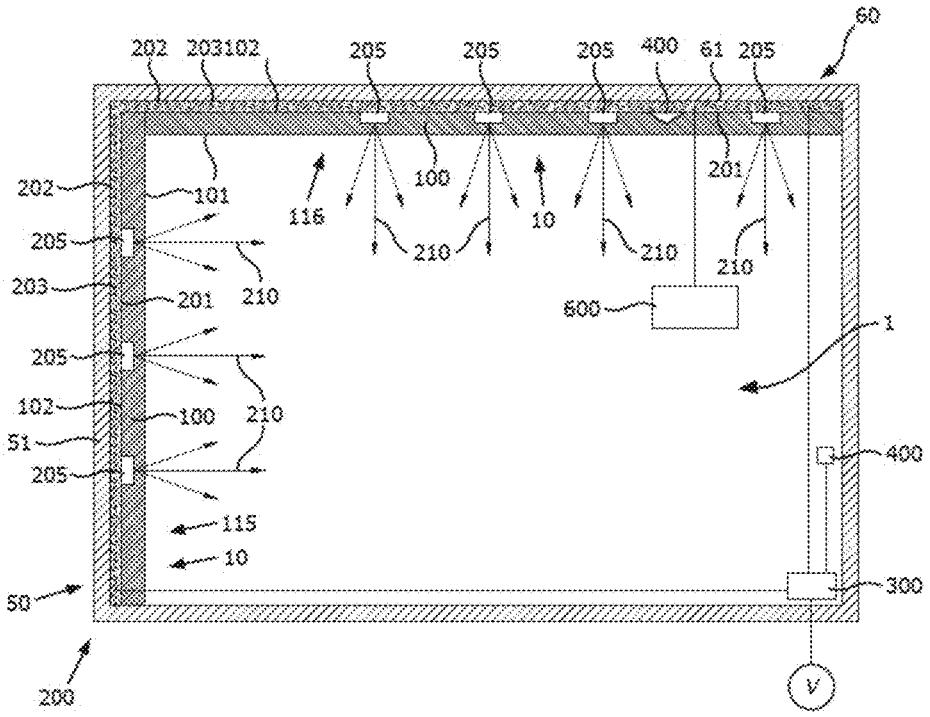
FIG. 5 schematically depicts an embodiment and variants thereof of the wall or ceiling covering arrangement according to the invention.

This embodiment shows that a user/observer observes the wall (or ceiling) as normal wall (or ceiling) when light is switched off, whereas when light is switched on, the observer/user is able to light emanating from the wall (or ceiling)/FIG. 5 schematically depicts an embodiment of the wall or ceiling covering arrangement 10 (here by way of example again both wall covering arrangement 115 and ceiling covering arrangement 116) further comprising a controller 300 arranged to control the lighting system 200, more precisely the light 210 that may be generated by the lighting system 200. The controller 300 may be arranged external from the lighting system, but may also be integrated in the lighting system 200. The controller 300 controls the one or more light sources 205. Optionally, the wall or ceiling covering arrangement 10 may further comprise a sensor 400. The controller 300 may then be arranged to control the light 210 of the lighting system 200 in response to a sensor signal of the sensor 400. The term "sensor" may also relate to a plurality of sensors. Such plurality of sensors may for instance be arranged to sense the same parameter (like touch of a user) at different locations, or to sense different parameters (like touch of a user and smoke, respectively).

The wall or ceiling covering arrangement 10 may be used to show decorative patterns, but may also be used to provide information, such as by providing a light pattern containing information like arrows, commercial information, etc. (see also above).

A person in room 1 (i.e. on the user side 101) of the covering material, is preferably not able to see the lighting system 200 (when in an off state). This may especially be achieved through the relatively low transmission of not more than about 15%, preferably not more than about 10%, such as 5% or lower.

In a further embodiment the wall or ceiling covering arrangement 10 is used to make an emergency escape route lighting system that may be activated in case of an emergency. The embodiment comprises the wall or ceiling covering arrangement 10 located on the wall or ceiling, respectively. The wall or ceiling covering arrangement 10 may comprise a plurality of light sources 205, which may optionally be connected with each other. The light transmissive covering material 100 is used to cover the lighting system 200. The lighting system 200 may for example be arranged to generate light 210 in the shape of light spots, but may also be in the shape of arrows, to point into the right direction for escape. This arrow may also be made variable, such that the direction of the arrow may be changed depending on the location of the emergency. For example, the arrow may point away from a fire hazard. Instead of an arrow, also blinking lights may be used to point into a direction. In this way, also information may be provided, like arrows indicating in a specific direction, commercial information. One or more of colour, pattern shape, on/off state, output intensity, and information content of the light 210 may be variable and may be controlled by the controller.

Further, one or more of colour, pattern shape and information content of the light 210 may be dependent on a sensor signal of a sensor (such as a touch or approach sensor or fire sensor or smoke sensor or thermal sensor, etc.) (not depicted), wherein the sensor is arranged to sense an object on or in the vicinity of the wall or ceiling covering arrangement 10 or is arranged to sense a feature selected from the group consisting of smoke and heat, and wherein the controller 300 is arranged to control one or more of colour, on/off state, intensity, pattern shape and information content of the light 210 in dependence of the sensor signal.

Optionally, the controller 300 may also control other apparatus, indicated with reference 600, such as other lighting sources. The light 210 may for instance be controlled in response to a sensor signal of one or more sensors 400. One or more of such sensors 400 may for instance be arranged to measure the light level (in a space or room), which light level may for instance at least partly receive a contribution of other light sources, including day light.

Figure 6:
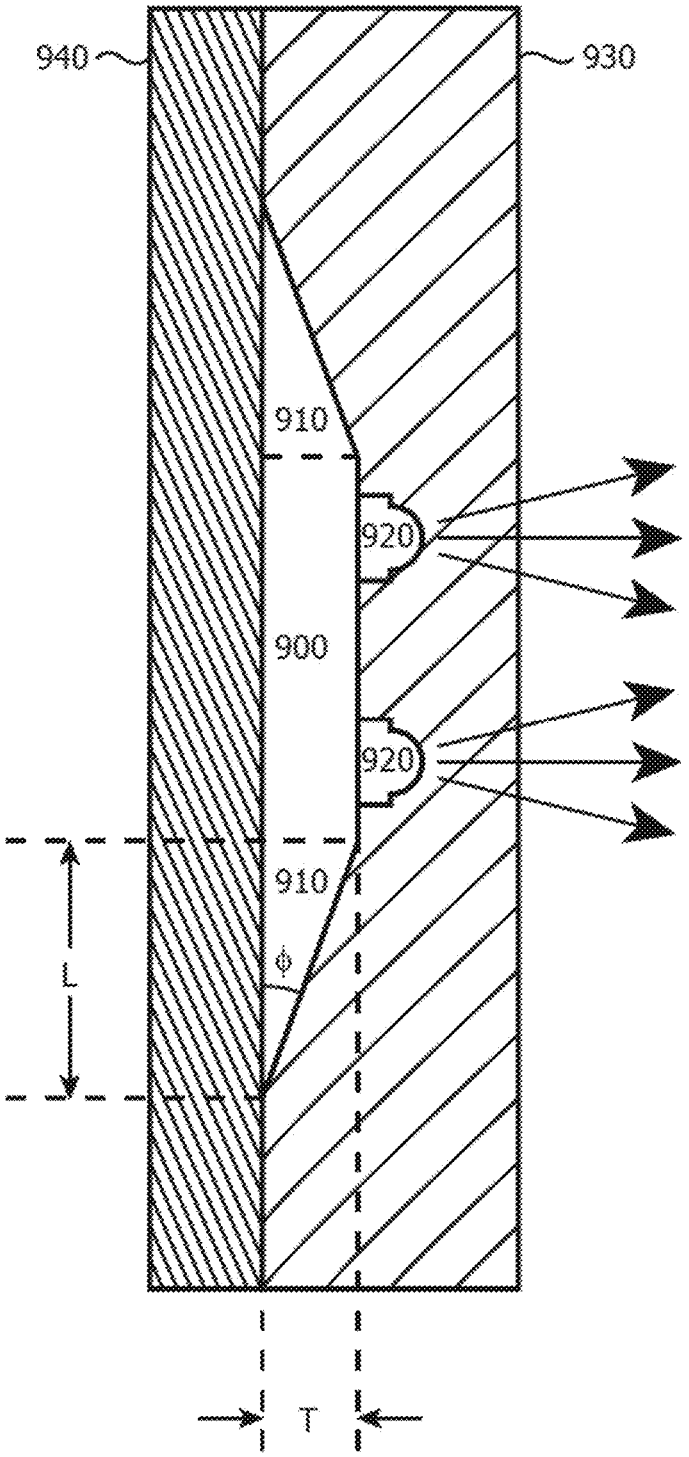
FIG. 6 schematically depicts a further embodiment of the wall or ceiling covering arrangement according to the invention.

Further preferred embodiments are shown in FIGS. 6A and 6B. In these embodiments, the lighting system 900 is provided on the wall 940 (but it may also be provided on a ceiling), and it is covered by the covering material 930. The lighting system 900 comprises light sources 920, and it has a wedge-shaped edge 910 (see FIG. 6A). The lighting system 900 has reduced visibility through the covering material 930 by having an edge 910 that gradually thins or narrows towards the surface of the wall 940 on which it is mounted. The wedge-shaped edge 910 may be characterized by the angle $\phi$ that is enclosed between the face of the wedge-shaped edge 910 that is adjacent to the wall 940 and the face that is adjacent to the covering material 930. Preferably, this angle $\phi$ is smaller than 6 degrees, more preferably smaller than 1.5 degrees, such as for example 1.1 degrees. This means that if the lighting system 900 has a thickness T of 1 mm, the wedge-shaped edge 910 of the lighting system 900 preferably has a length L of more than 1 cm, more preferably more than 4 cm, such as for example 5 cm. As shown in FIG. 6B, the wedge-shaped edge may be created from a stack of paper layers 911, 912, 913 and 914. Any other kind of liquid transporting layers may also be used to provide a similar wedge-shaped edge. In this way, the wedge-shaped edge does not only serve to reduce the visibility of the lighting system through the covering material, but also to improve the drying speed of an adhesive layer that is used to attach the covering material, particularly of a water-based adhesive layer, such as wallpaper paste.

The wall or ceiling arrangement according to the invention may further comprise a compartment for housing a backup power battery. This compartment may also contain electronic components for checking the operation of the wall or ceiling arrangement. The compartment may be connected to an electrical conduit (such as a PVC pipe) through which power supply and control wires can reach the lighting system. Preferably, the compartment is open at the surface of the wall or ceiling, and the lighting system is mounted over the compartment to close it off after an electrical connection is made between the lighting system and any electrical wires in the compartment. Preferably, the electrical conduit leads to a location in the wall or ceiling where a power supply may be placed, either directly or via one or more intermediate compartments.

For easy removal and replacement of the lighting system, the wall or ceiling arrangement according to the invention may comprise a cover material that is cut along the rim of the lighting system. In this way, the lighting system may be removed without the need to remove the cover material. This may, for example, be facilitated using a press and release system to place and remove the lighting system.

The wall or ceiling covering arrangement according to the invention may be used for guiding people to certain locations in a building. For example, it may be used as an emergency exit sign, as defined in standards such as NEN 6088. The aesthetics of an emergency exit sign based on the wall or ceiling arrangement according to the invention are strongly improved with respect to the known emergency exit signs, because no housing will be visible (however, the light may remain visible at all time, because emergency exit signs are normally always lit).

The wall or ceiling covering arrangement according to the invention may also be an interactive system for guiding people to certain locations in a building. For example, a person may receive a badge with a radio-frequency identification (RFID) chip that corresponds with a certain location in a building. That person can then touch a wall with the badge, after which arrows in the wall will show in which direction the person should walk. After a certain time period (for example 20 seconds), this way-guiding information disappears again. In this example, an RFID reader may be located inside a compartment within a wall that is provided with a wall covering arrangement according to the invention. During standby operation one light source of the lighting system might be switched on at the location above the compartment that holds the RFID reader. When the user's badge is swiped over the location of this one light source, the RFID reader located in the nearby compartment will detect the RFID chip in the badge. The lighting system, and preferably also other nearby lighting systems, will then show the way in which the person should walk. After a certain time, this information disappears and the light source indicating the location of the RFID reader is switched on again. There are several ways how the covering arrangement can know the direction in which the person should walk. In one example, there is a data connection between the RFID reader and a central data system. Using this data connection the RFID reader can request way-finding information based on the RFID chip that was detected. The advantage of this approach is that it is easy to change routes through a building, for example when one corridor is temporarily unavailable. In another example the RFID reader contains a memory chip on which way-finding information is stored for every possible RFID chip that may be detected. The advantage of this approach is that no data connection with a central data system is needed. In order to also turn on nearby lighting systems there should be a data connection between lighting systems. This may be achieved through the central data system, or it may be achieved locally, using locally interconnected lighting systems. Next to using an RFID reader to detect a badge, other suitable identification methods may be also be used.

The term "substantially" herein, such as in "substantially flat" or in "substantially consists", etc., will be understood by the person skilled in the art. In embodiments the adjective substantially may be removed. Where applicable, the term "substantially" may also include embodiments with "entirely", "completely", "all", etc. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". Likewise, the term about may, where applicable, indicate a deviation of 10% or less, or 5% or less, or 1% or less, or 0.5% or less, or even 0.1% or less, and also in an embodiment no (measureable) deviation. As will be clear to the person skilled in the art, small deviations from numerical values may, where applicable, in general be allowed. Hence, except for the values in the definition of about above, numerical values may, where applicable deviate a 10% or less, or 5% or less, or 1% or less, or 0.5% or less, or even 0.1% or less from the given value. To stress this, herein sometimes the word "about" is used before numerical values.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A wall or ceiling covering arrangement comprising:

a covering material having a user side and an opposite back side;

a support layer comprising a printed circuit board; and a lighting system layer arranged on the printed circuit board to generate light, the lighting system layer located between the covering material and the support layer, wherein the lighting system layer comprises a plurality of spaced lighting units, wherein the covering material has a light transmission for the light generated by the lighting system layer in the range of 0.5% to 30%, wherein the covering material comprises wallpapers attached to the lighting system through a transparent adhesive layer, and wherein the covering material is a light transmission medium for the light and wherein the lighting system layer is primarily and substantially covered by the covering material.

2. The wall or ceiling covering arrangement according to claim 1, wherein the covering material comprises a plaster comprising stone granules and a binder.

3. The wall or ceiling covering arrangement according to claim 1, further comprising an auxiliary layer, arranged between at least part of the lighting system and at least part of the covering material, wherein the auxiliary layer comprises one or more of a levelling layer, a scratch resistance layer, and a liquid-tight layer.

4. The wall or ceiling covering arrangement according to claim 1, wherein the wall or ceiling covering arrangement further comprises a controller arranged to control the lighting system.

5. A lighting system for use in the wall or ceiling covering arrangement according to claim 1, wherein the printed circuit board has one or more recesses arranged to host one or more light sources.

6. Alighting system for use in the wall or ceiling covering arrangement according to claim 1, comprising a top side for facing the covering material and a back side for facing the wall or ceiling, the top side having adhesion promoting properties.

7. Alighting system for use in the wall or ceiling covering arrangement according to claim 1, comprising a wedge-shaped edge having a first face for being adjacent to the wall or ceiling, and a second face for being adjacent to the covering material, the first face and the second face enclosing an angle .phi. that is smaller than 6 degrees.

8. A lighting system for use in the wall or ceiling covering arrangement according to claim 1, comprising one or more light sources provided on the printed circuit board, the lighting system having a top side for facing the covering material, and a back side for facing the wall or ceiling, wherein at the top side the lighting system comprises one or more auxiliary layers chosen from the group consisting of levelling layers and protective layers.

9. The lighting system according to claim 8, wherein the one or more auxiliary layers comprise a liquid-tight protective layer, and wherein the lighting system further comprises a liquid-transporting layer at the side of the liquid-tight protective layer facing away from the printed circuit board.

10. Use of a wall or ceiling covering arrangement according to claim 1 for way guiding.

11. A way-guiding system comprising the wall or ceiling covering arrangement according to claim 1.

12. The way-guiding system according to claim 11, being an emergency exit finding system.

13. A method for providing a wall or ceiling covering arrangement according to claim 1 to a wall or a ceiling comprising:

arranging a lighting system to the wall or ceiling; and applying covering material over the lighting system.

14. The method according to claim 13, further comprising:

providing one or more recesses to the wall or ceiling; and arranging the lighting system in the one or more recesses.

15. The wall or ceiling covering arrangement according to claim 1, wherein the wallpapers comprise at least one of a vinyl wallpaper and a glass fiber wallpaper.

16. A wall or ceiling covering arrangement comprising:

a covering material having a user side and an opposite back side;

a lighting system arranged on the back side of the covering material, and to generate light;

wherein the covering material has a light transmission for the light generated by the lighting system in the range of 0.5% to 30%; and wherein the covering material comprises wallpapers attached to the lighting system through a transparent adhesive layer, and wherein the covering material is a light transmission medium for the light and wherein the lighting system is primarily and substantially covered by the covering material.

17. The wall or ceiling covering arrangement according to claim 16, wherein the wallpapers comprise at least one of a vinyl wallpaper and a glass fiber wallpaper.

* * * * *